US010600537B1

(12) United States Patent
Zhang et al.

(10) Patent No.: US 10,600,537 B1
(45) Date of Patent: Mar. 24, 2020

(54) ELECTRICAL CABLE

(71) Applicant: TE CONNECTIVITY CORPORATION, Berwyn, PA (US)

(72) Inventors: Noah Zhengxue Zhang, Westford, MA (US); Megha Shanbhag, Sunnyvale, CA (US); Craig Warren Hornung, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/159,053

(22) Filed: Oct. 12, 2018

(51) Int. Cl.

| | |
|---|---|
| ***H01B 11/04*** | (2006.01) |
| ***H01B 11/10*** | (2006.01) |
| ***H01B 7/18*** | (2006.01) |
| ***H01B 7/08*** | (2006.01) |
| *H01B 11/00* | (2006.01) |

(52) U.S. Cl.
CPC ..... *H01B 11/1016* (2013.01); *H01B 7/0823* (2013.01); *H01B 7/18* (2013.01); *H01B 11/002* (2013.01)

(58) Field of Classification Search
CPC ..... H01B 11/002; H01B 11/04
See application file for complete search history.

(56) References Cited

U.S. PATENT DOCUMENTS

| | | | |
|---|---|---|---|
| 3,340,353 | A | 9/1967 | Mildner |
| 3,439,111 | A | 4/1969 | Miracle et al. |
| 4,221,926 | A | 9/1980 | Schneider |
| 4,596,897 | A | 6/1986 | Gruhn |
| 4,644,092 | A | 2/1987 | Gentry |
| 5,142,100 | A | 8/1992 | Vaupotic |
| 5,329,064 | A | 7/1994 | Tash et al. |
| 5,349,133 | A | 9/1994 | Rogers |
| 5,619,016 | A | 4/1997 | Newmoyer |
| 6,010,788 | A | 1/2000 | Kebabjian et al. |

(Continued)

FOREIGN PATENT DOCUMENTS

| | | |
|---|---|---|
| CN | 201327733 | 10/2009 |
| CN | 201359878 | 12/2009 |

(Continued)

OTHER PUBLICATIONS

Co-pending U.S. Appl. No. 15/925,243, filed Mar. 19, 2018.

(Continued)

*Primary Examiner* — Chau N Nguyen

(57) ABSTRACT

An electrical cable includes a conductor assembly having a first conductor, a second conductor, and an insulator structure surrounding the first conductor and the second conductor. The first and second conductors carry differential signals. The insulator structure has an outer surface. A cable shield is wrapped around the conductor assembly and engages the outer surface of the insulator structure. The cable shield has an inner edge and a flap covering the inner edge. The cable shield forms a void at the inner edge being located closer to the first conductor than the second conductor. The air void compromising the first conductor by reducing an effective dielectric constant surrounding the first conductor. The first conductor is shifted closer to the cable shield a shift distance compared to the second conductor to increase capacitance of the first conductor compared to the second conductor.

20 Claims, 2 Drawing Sheets

(56) References Cited

U.S. PATENT DOCUMENTS

| | | | | |
|---|---|---|---|---|
| 6,403,887 | B1 | 6/2002 | Kebabjian et al. | |
| 6,504,379 | B1 | 1/2003 | Jackson | |
| 6,677,518 | B2 | 1/2004 | Hirakawa et al. | |
| 7,314,998 | B2 | 1/2008 | Amato et al. | |
| 7,790,981 | B2 | 9/2010 | Vaupotic et al. | |
| 7,827,678 | B2 | 11/2010 | Dion et al. | |
| 7,999,185 | B2 | 8/2011 | Cases et al. | |
| 8,378,217 | B2 | 2/2013 | Sugiyama et al. | |
| 8,381,397 | B2 | 2/2013 | Dion et al. | |
| 8,440,910 | B2 | 5/2013 | Nonen et al. | |
| 8,546,691 | B2 | 10/2013 | Watanabe et al. | |
| 8,552,291 | B2 | 10/2013 | Lingambudi et al. | |
| 8,575,488 | B2 | 11/2013 | Sugiyama et al. | |
| 8,674,228 | B2 | 3/2014 | Dion et al. | |
| 8,866,010 | B2 | 10/2014 | Nonen et al. | |
| 8,981,216 | B2 | 3/2015 | Grant et al. | |
| 8,993,883 | B2 | 3/2015 | Kumakura et al. | |
| 9,064,621 | B2 | 6/2015 | Kodama et al. | |
| 9,117,572 | B2 | 8/2015 | Fukasaku | |
| 9,123,452 | B2 | 9/2015 | Sugiyama et al. | |
| 9,123,457 | B2 | 9/2015 | Kaga et al. | |
| 9,136,042 | B2 | 9/2015 | Sugiyama et al. | |
| 9,142,333 | B2 | 9/2015 | Kaga et al. | |
| 9,159,472 | B2 | 10/2015 | Nordin et al. | |
| 9,214,260 | B2 | 12/2015 | Ishikawa et al. | |
| 9,299,481 | B2 | 3/2016 | Ishikawa et al. | |
| 9,349,508 | B2 | 5/2016 | Nonen et al. | |
| 9,350,571 | B2 | 5/2016 | Watanabe et al. | |
| 9,384,873 | B2 * | 7/2016 | Yonezawa | H01B 11/002 |
| 9,466,408 | B2 | 10/2016 | Sugiyama | |
| 9,484,127 | B2 | 11/2016 | Sugiyama et al. | |
| 9,496,071 | B2 | 11/2016 | Nagagashi | |
| 9,548,143 | B2 | 1/2017 | Sugiyama et al. | |
| 9,583,235 | B2 | 2/2017 | Nonen et al. | |
| 9,660,318 | B2 | 5/2017 | Sugiyama et al. | |
| 9,883,581 | B2 * | 1/2018 | Kodama | H01B 11/1869 |
| 2003/0150633 | A1 | 8/2003 | Hirakawa et al. | |
| 2006/0254801 | A1 | 11/2006 | Stevens | |
| 2010/0307790 | A1 | 12/2010 | Okano | |
| 2011/0100682 | A1 | 5/2011 | Nonen et al. | |
| 2011/0127062 | A1 | 6/2011 | Cases et al. | |
| 2012/0024566 | A1 | 2/2012 | Shimosawa et al. | |
| 2012/0080211 | A1 | 4/2012 | Brown et al. | |
| 2012/0152589 | A1 | 6/2012 | Kumakura et al. | |
| 2012/0227998 | A1 | 9/2012 | Lindstrom et al. | |
| 2013/0175081 | A1 | 7/2013 | Watanabe et al. | |
| 2013/0333913 | A1 | 12/2013 | Nonen et al. | |
| 2014/0048302 | A1 | 2/2014 | Nonen et al. | |
| 2014/0102783 | A1 | 4/2014 | Nagahashi et al. | |
| 2014/0305676 | A1 | 10/2014 | Sugiyama et al. | |
| 2015/0000954 | A1 | 1/2015 | Nonen et al. | |
| 2015/0255928 | A1 | 9/2015 | Liptak et al. | |
| 2016/0111187 | A1 | 4/2016 | Kodama | |
| 2016/0155540 | A1 | 6/2016 | Matsuda et al. | |
| 2016/0300642 | A1 | 10/2016 | Kodama et al. | |
| 2016/0343474 | A1 | 11/2016 | Nichols | |
| 2016/0372235 | A1 | 12/2016 | Sugiyama et al. | |
| 2017/0103830 | A1 | 4/2017 | Dettmer et al. | |
| 2018/0096755 | A1 | 4/2018 | Tsujino et al. | |

FOREIGN PATENT DOCUMENTS

| | | |
|---|---|---|
| CN | 102231303 | 11/2011 |
| CN | 203931605 | 11/2014 |
| CN | 105741965 | 7/2016 |
| JP | 2000040423 | 2/2000 |
| JP | 2001093357 | 4/2001 |
| JP | 2012009321 | 1/2012 |
| JP | 2012238468 | 12/2012 |
| JP | 2013038082 | 2/2013 |
| JP | 2013258009 | 12/2013 |
| JP | 2014038802 | 2/2014 |
| JP | 2014078339 | 5/2014 |
| JP | 2014099404 | 5/2014 |
| JP | 2014142247 | 8/2014 |
| JP | 2014154490 | 8/2014 |
| JP | 2014157709 | 8/2014 |
| JP | 2015076138 | 4/2015 |
| JP | 2015146298 | 8/2015 |
| JP | 2015204195 | 11/2015 |
| JP | 2015230836 | 12/2015 |
| JP | 2016015255 | 1/2016 |
| JP | 2016027547 | 2/2016 |
| JP | 2016072007 | 5/2016 |
| JP | 2016072196 | 5/2016 |
| JP | 2016110960 | 6/2016 |
| JP | 2016213111 | 12/2016 |
| WO | 96041351 | 12/1996 |

OTHER PUBLICATIONS

Co-pending U.S. Appl. No. 15/925,265, filed Mar. 19, 2018.
Co-pending U.S. Appl. No. 15/969,264, filed May 2, 2018.
Co-pending U.S. Appl. No. 15/952,690, filed Apr. 13, 2018.
Co-pending U.S. Appl. No. 16/159,003, filed Oct. 12, 2018.

* cited by examiner

ELECTRICAL CABLE

BACKGROUND OF THE INVENTION

The subject matter herein relates generally to electrical cables that provide shielding around signal conductors.

Shielded electrical cables are used in high-speed data transmission applications in which electromagnetic interference (EMI) and/or radio frequency interference (RFI) are concerns. Electrical signals routed through shielded cables may radiate less EMI/RFI emissions to the external environment than electrical signals routed through non-shielded cables. In addition, the electrical signals being transmitted through the shielded cables may be better protected against interference from environmental sources of EMI/RFI than signals through non-shielded cables.

Shielded electrical cables are typically provided with a cable shield formed by a tape wrapped around the conductor assembly. Signal conductors are typically arranged in pairs conveying differential signals. The signal conductors are surrounded by an insulator and the cable shield is wrapped around the insulator. However, where the cable shield overlaps itself, a void is created that is filled with air, which has a different dielectric constant than the material of the insulator and shifts the cable shield farther from the signal conductor. The void affects the electrical performance of the conductors in the electrical cable by changing the effective dielectric constant of the material surrounding one of the conductors compared to the other of the conductors within the differential pair, leading to electrical skew.

A need remains for an electrical cable that improves signal performance.

BRIEF DESCRIPTION OF THE INVENTION

In an embodiment, an electrical cable is provided including a conductor assembly having a first conductor, a second conductor, and an insulator structure surrounding the first conductor and the second conductor. The first and second conductors carry differential signals. The insulator structure has an outer surface. A cable shield is wrapped around the conductor assembly and engages the outer surface of the insulator structure. The cable shield has an inner edge and a flap covering the inner edge. The cable shield forms a void at the inner edge being located closer to the first conductor than the second conductor. The air void compromising the first conductor by reducing an effective dielectric constant surrounding the first conductor. The first conductor is shifted closer to the cable shield a shift distance compared to the second conductor to increase capacitance of the first conductor compared to the second conductor.

In another embodiment, an electrical cable is provided including a conductor assembly having a first conductor, a second conductor, and an insulator structure surrounding the first conductor and the second conductor. The first and second conductors carry differential signals. The insulator structure has an outer surface including a first outer end and a second outer end opposite the first outer end. The insulator structure has a bisector axis centered between the first outer end and the second outer end. The first conductor is a first bisector distance from the bisector axis and the second conductor is a second bisector distance from the bisector axis. The first bisector distance is greater than the second bisector distance. A cable shield is wrapped around the conductor assembly and engages the outer surface of the insulator structure. The cable shield has an inner edge and a flap covering the inner edge. The cable shield forms a void at the inner edge located closer to the first conductor than the second conductor.

DETAILED DESCRIPTION OF THE INVENTION

Figure 1:
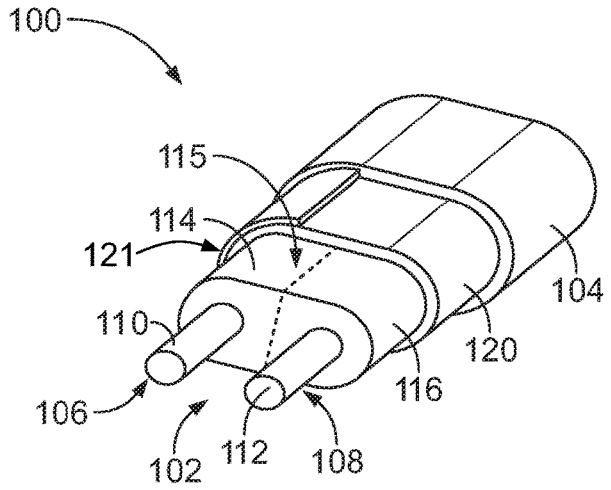
FIG. 1 is a perspective view of a portion of an electrical cable formed in accordance with an embodiment.

FIG. 1 is a perspective view of a portion of an electrical cable 100 formed in accordance with an embodiment. The electrical cable 100 may be used for high speed data transmission between two electrical devices, such as electrical switches, routers, and/or host bus adapters. For example, the electrical cable 100 may be configured to transmit data signals at speeds of at least 10 gigabits per second (Gbps), which is required by numerous signaling standards, such as the enhanced small form-factor pluggable (SFP+) standard. For example, the electrical cable 100 may be used to provide a signal path between high speed connectors that transmit data signals at high speeds.

The electrical cable 100 includes a conductor assembly 102. The conductor assembly 102 is held within an outer jacket 104 of the electrical cable 100. The outer jacket 104 surrounds the conductor assembly 102 along a length of the conductor assembly 102. In FIG. 1, the conductor assembly 102 is shown protruding from the outer jacket 104 for clarity in order to illustrate the various components of the conductor assembly 102 that would otherwise be obstructed by the outer jacket 104. It is recognized, however, that the outer jacket 104 may be stripped away from the conductor assembly 102 at a distal end 106 of the cable 100, for example, to allow for the conductor assembly 102 to terminate to an electrical connector, a printed circuit board, or the like. In an alternative embodiment, the electrical cable 100 does not include the outer jacket 104.

The conductor assembly 102 includes inner conductors arranged in a pair 108 that are configured to convey data signals. In an exemplary embodiment, the pair 108 of conductors defines a differential pair conveying differential signals. The conductor assembly 102 includes a first conductor 110 and a second conductor 112. In various embodiments, the conductor assembly 102 is a twin-axial differential pair conductor assembly. In an exemplary embodiment, the conductor assembly 102 includes an insulator structure 115 surrounding the conductors 110, 112. The insulator structure 115 includes a first insulator 114 and a second insulator 116 surrounding the first and second conductors 110, 112, respectively. In various embodiments, the insulator structure 115 is a monolithic, unitary insulator surrounding both conductors 110, 112. For example, the first and second insulators may be formed by extruding the insulator structure 115 with both conductors 110, 112 simultaneously. In other various embodiments, the first and second insulators 114, 116 may be separate and discrete insulators sandwiched together within the cable core of the electrical cable 100. The conductor assembly 102 includes a cable shield 120 surrounding the conductor assembly 102 and providing electrical shielding for the conductors 110, 112.

The conductors 110, 112 extend longitudinally along the length of the cable 100. The conductors 110, 112 are formed of a conductive material, for example a metal material, such as copper, aluminum, silver, or the like. Each conductor 110, 112 may be a solid conductor or alternatively may be composed of a combination of multiple strands wound together. The conductors 110, 112 extend generally parallel to one another along the length of the electrical cable 100.

The first and second insulators 114, 116 surround and engage outer perimeters of the corresponding first and second conductors 110, 112. As used herein, two components "engage" or are in "engagement" when there is direct physical contact between the two components. The insulator structure 115 (for example, the insulators 114, 116) is formed of a dielectric material, for example one or more plastic materials, such as polyethylene, polypropylene, polytetrafluoroethylene, or the like. The insulator structure 115 may be formed directly to the inner conductors 110, 112 by a molding process, such as extrusion, overmolding, injection molding, or the like. The insulator structure 115 extends between the conductors 110, 112 and extends between the cable shield 120 and the conductors 110, 112. The insulators 114, 116 separate or space apart the conductors 110, 112 from one another and separate or space apart the conductors 110, 112 from the cable shield 120. The insulators 114, 116 maintain separation and positioning of the conductors 110, 112 along the length of the electrical cable 100. The size and/or shape of the conductors 110, 112, the size and/or shape of the insulators 114, 116, and the relative positions of the conductors 110, 112 and the insulators 114, 116 may be modified or selected in order to attain a particular impedance for the electrical cable 100. In an exemplary embodiment, the conductors 110, 112 and/or the insulators 114, 116 may be asymmetrical to compensate for skew imbalance induced by the cable shield 120 on either or both of the conductors 110, 112. For example, in an exemplary embodiment, the first conductor 110 is shifted closer to the cable shield 120 compared to the second conductor 112 to increase capacitance in the first conductor 110, which compensates for the decrease in capacitance in the first conductor 110 due to the void near the first conductor formed by wrapping the longitudinal cable shield 120 around the cable core. In various embodiments, the first insulator 114 has a reduced thickness between the first conductor and the cable shield 120, such as at the side and/or at the top and/or at the bottom to increase capacitance in the first conductor 110, which compensates for the decrease in capacitance in the first conductor 110 due to the void near the first conductor 110 formed by wrapping the longitudinal cable shield 120 around the cable core.

The cable shield 120 engages and surrounds the outer perimeter of the insulator structure 115. In an exemplary embodiment, the cable shield 120 is wrapped around the insulator structure 115. For example, in an exemplary embodiment, the cable shield 120 is formed as a longitudinal wrap, otherwise known as a cigarette wrap, where a seam 121 of the wrap extends longitudinally along the electrical cable 100. The seam 121, and thus the void created by the seam 121, is in the same location along the length of the electrical cable 100. The cable shield 120 is formed, at least in part, of a conductive material. In an exemplary embodiment, the cable shield 120 is a tape configured to be wrapped around the cable core. For example, the cable shield 120 may include a multi-layer tape having a conductive layer and an insulating layer, such as a backing layer. The conductive layer and the backing layer may be secured together by adhesive. An adhesive layer may be provided along the interior of the cable shield 120 to secure the cable shield 120 to the insulator structure 115 and/or itself. The adhesive layer may be provided along the exterior of the cable shield for connection of a shield wrap around the cable shield 120. The conductive layer may be a conductive foil or another type of conductive layer. The insulating layer may be a polyethylene terephthalate (PET) film, or similar type of film. The conductive layer provides both an impedance reference layer and electrical shielding for the first and second conductors 110, 112 from external sources of EMI/RFI interference and/or to block cross-talk between other conductor assemblies 102 or electrical cables 100. In an exemplary embodiment, the electrical cable 100 includes a wrap (not shown) or another layer around the cable shield 120 that holds the cable shield 120 on the insulators 114, 116. For example, the electrical cable 100 may include a helical wrap. The wrap may be a heat shrink wrap. The wrap is located inside the outer jacket 104.

The outer jacket 104 surrounds and engages the outer perimeter of the cable shield 120. In the illustrated embodiment, the outer jacket 104 engages the cable shield 120 along substantially the entire periphery of the cable shield 120. The outer jacket 104 is formed of at least one dielectric material, such as one or more plastics (for example, vinyl, polyvinyl chloride (PVC), acrylonitrile butadiene styrene (ABS), or the like). The outer jacket 104 is non-conductive, and is used to insulate the cable shield 120 from objects outside of the electrical cable 100. The outer jacket 104 also protects the cable shield 120 and the other internal components of the electrical cable 100 from mechanical forces, contaminants, and elements (such as fluctuating temperature and humidity). Optionally, the outer jacket 104 may be extruded or otherwise molded around the cable shield 120. Alternatively, the outer jacket 104 may be wrapped around the cable shield 120 or heat shrunk around the cable shield 120.

Figure 2:
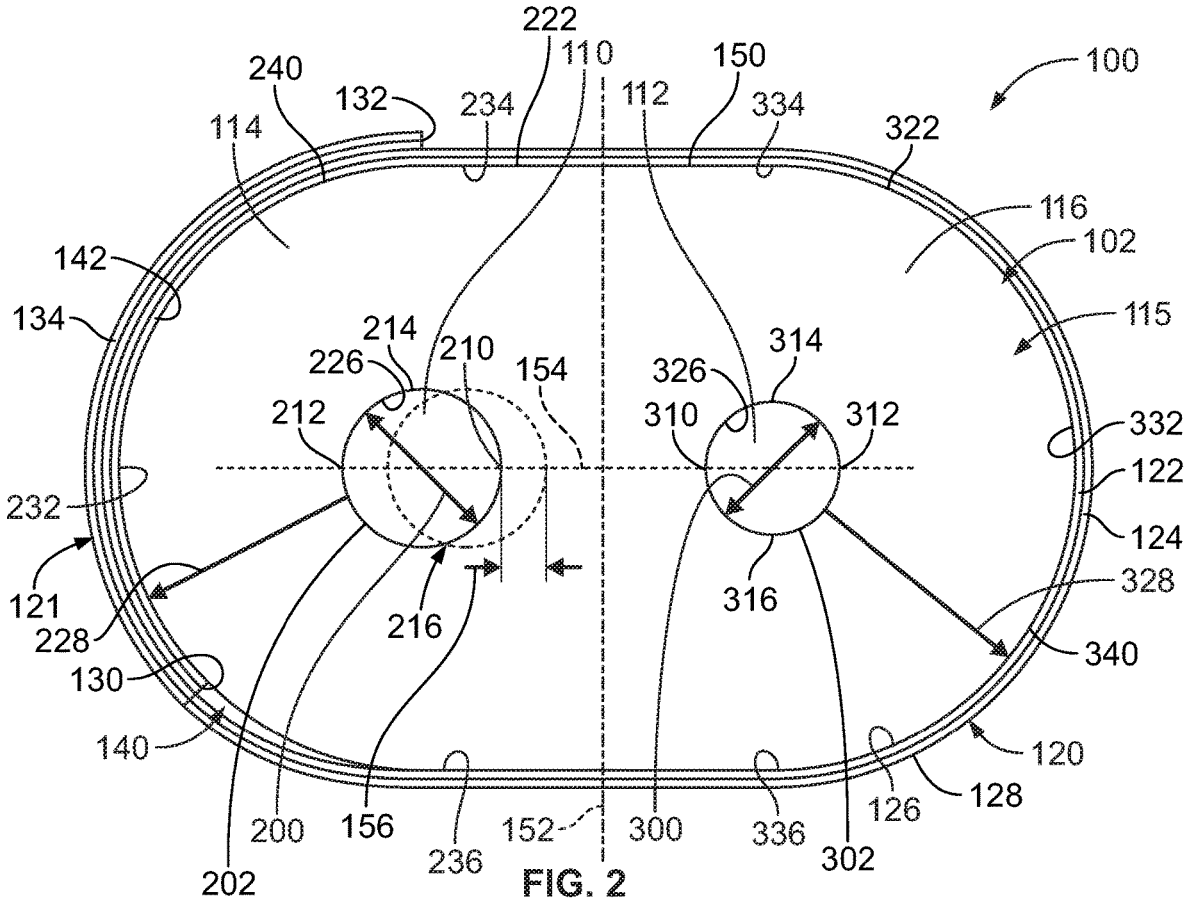
FIG. 2 is a cross-sectional view of a conductor assembly of the electrical cable in accordance with an exemplary embodiment.

FIG. 2 is a cross-sectional view of the conductor assembly 102 in accordance with an exemplary embodiment. The cable shield 120 is wrapped around the insulator structure 115 in the cable core. The cable shield 120 includes a conductive layer 122 and an insulating layer 124. In the illustrated embodiment, the insulating layer 124 is provided on an interior 126 of the cable shield 120 and the conductive layer 122 is provided on an exterior 128 of the cable shield 120; however, the conductive layer 122 may be provided on the interior of the cable shield in alternative embodiments.

The cable shield 120 includes an inner edge 130 and an outer edge 132. When the cable shield 120 is wrapped around the cable core, a flap 134 of the cable shield 120 overlaps the inner edge 130 and a segment 142 of the cable shield 120 on a seam side of the electrical cable 100. The overlapping portion of the cable shield 120 forms the seam 121 along the seam side of the electrical cable 100. The interior 126 of the flap 134 may be secured to the exterior 128 of the segment 142 at the seam 121, such as using adhesive. The interior 126 of the cable shield 120 may be secured directly to the insulator structure 115, such as using adhesive. In addition, or in lieu of adhesive, the cable shield 120 may be held in place around the cable core by an additional helical wrap, such as a heat shrink wrap.

When the cable shield 120 is wrapped over itself to form the flap 134, a void 140 is created at the seam 121 of the electrical cable 100. In various embodiments, the void 140 is a pocket of air defined between the interior 126 of an elevated segment 142 of the cable shield 120 and the insulator structure 115, such as at the first insulator 114. The void 140 may be referred to hereinafter as an air void 140. However, in other various embodiments, the void 140 may be filled with another material, such as adhesive or other dielectric material. The elevated segment 142 is elevated or lifted off of the first insulator 114 to allow the flap 134 to clear the inner edge 130. The elevated segment 142 moves the cable shield 120 farther from the first conductor 110, which affects the inductance and capacitance of the first conductor 110. The volume of the air (or other dielectric material) in the void 140 affects the electrical characteristics of the nearest conductor, such as the first conductor 110, by changing the effective dielectric constant of the dielectric material between the first conductor 110 and the conductive layer 122 of the cable shield 120. The air in the void 140 and/or moving the elevated segment 142 farther from the first conductor 110 reduces the effective dielectric constant experienced by the first conductor 110. Since capacitance is directly proportional to the effective dielectric constant, the capacitance for the first conductor is reduced. Propagation delay through the first conductor 110 is directly proportional to the capacitance and the inductance of the first conductor 110. With the lower capacitance, the first conductor 110 experiences a reduced delay (increase in signal speed), which results in signal skew. The decrease in the capacitance of the first conductor 110 speeds up the signals in the first conductor 110 (compared to the second conductor 112 that does not have the void 140 adjacent thereto), leading to a skew imbalance for the electrical cable 100. While it may be desirable to reduce the volume of the void 140, the presence of the void 140 is inevitable when the electrical cable 100 is assembled due to the flap 134 overlapping the segment 142.

The air in the void 140 leads to a skew imbalance for the first conductor 110 by changing the effective dielectric constant of the dielectric material around the first conductor 110, compared to the second conductor 112. For example, signals transmitted by the first conductor 110 may be transmitted faster than the signals transmitted by the second conductor 112, leading to skew in the differential pair. Signal delay in the conductor is a function of inductance and capacitance of the conductor. Delay is the square root of inductance times capacitance. The speed of the signal in the conductor is the inverse of the delay, and is thus also a function of inductance and capacitance. Capacitance of the first conductor 110 is lowered by the void 140 due to its change on the effective dielectric constant. Capacitance of the first conductor 110 is lowered because the cable shield 120 along the void 140 (for example, the flap 134) is shifted farther away from the first conductor 110 along the void 140.

In various embodiments, decrease in capacitance of the first conductor 110, due to the void 140, is compensated with a proportional increase in capacitance in the first conductor 110 to keep the delay similar to the signal in the second conductor 112 and thus mitigate skew imbalance. In an exemplary embodiment, the capacitance of the first conductor 110 is increased by shifting the first conductor 110 closer to the cable shield 120 compared to the second conductor 112. The capacitance of the first conductor 110 may be increased by decreasing the shield distance between the first conductor 110 and the cable shield 120, compared to the second conductor 112, such as by moving the first conductor 110 closer to the cable shield 120 or by reducing the thickness of the first insulator 114.

In FIG. 2, the insulator structure 115 is one integral, monolithic member that surrounds and extends between the first and second conductors 110, 112. For example, the conductor assembly 102 may be formed by molding, extruding or otherwise applying the material of the insulator structure 115 to the first and second conductors 110, 112 at the same time. The conductor assembly 102 forms a twin-axial insulated core, and the cable shield 120 is subsequently applied around the twin-axial insulated core. In various embodiments, the outer perimeter of the insulator structure 115 may have a generally elliptical or oval shape. For example, the insulator structure 115 may be elongated side-side-to-side and narrow top-to-bottom. It is recognized that the insulator structure 115 need not have the elliptical shape in other embodiments.

The cable shield 120 generally conforms to the insulator structure 115, except at the void 140. In an embodiment, the cross-sectional shape of the cable shield 120 is geometrically similar to the cross-sectional shape of the outer perimeter of the insulator structure 115. The term "geometrically similar" is used to mean that two objects have the same shape, although different sizes, such that one object is scaled relative to the other object. As shown in FIG. 2, the outer perimeter of the cable shield 120 has a generally elliptical or oval shape along the cross-section (other than at the void 140), which is similar to the outer perimeter of the insulator structure 115.

The insulator structure 115 has an outer surface 150. The cable shield 120 is applied to the outer surface 150. The material of the insulator structure 115 closer to the first conductor 110 insulates the first conductor 110 from the second conductor 112 and from the cable shield 120 and thus defines the first insulator 114. The material of the insulator structure 115 closer to the second conductor 112 insulates the second conductor 112 from the first conductor 110 and from the cable shield 120 and thus defines the second insulator 116.

In an exemplary embodiment, the shape of the insulator structure 115 may be symmetrical about a bisector axis 152 between the first and second conductors 110, 112. In the illustrated embodiment, the bisector axis 152 is oriented vertically along the minor axis of the insulator structure 115. The first and second insulators 114, 116 of the insulator structure are defined on opposite sides of the bisector axis 152 centered between opposite outer ends of the insulator structure 115. The first and second insulators 114, 116 may be symmetrical about the bisector axis 152. For example, the first and second insulators 114, 116 may be mirrored about the bisector axis 152. The bisector axis 152 is located between the first and second conductors 110, 112. In various embodiments, the first and second conductors are asymmetrically positioned within the insulator structure 115. For example, the first conductor 110 is located further from the bisector axis 152 than the second conductor 112.

In an exemplary embodiment, the first conductor 110 has a first conductor outer surface 202 having a circular cross-section having a first diameter 200. The first conductor 110 has an inner end 210 facing the second conductor 112 and an outer end 212 opposite the inner end 210. The first conductor 110 has a first side 214 (for example, a top side) and a second side 216 (for example, a bottom side) opposite the first side 214. The first and second sides 214, 216 are equidistant from the inner and outer ends 210, 212.

In an exemplary embodiment, the first insulator 114 surrounds the first conductor 110 and has a first insulator outer surface 222, defining a portion of the outer surface 150 of the insulator structure 115. A thickness of the first insulator 114 between the first conductor 110 and the first insulator outer surface 222 defines a first shield distance 228 between the first conductor 110 and the cable shield 120. Optionally, the shield distance 228 may be variable. For example, the shield distance 228 between the outer end 212 of the first conductor 110 and the cable shield 120 may be different (for example, less than) the shield distance 228 between the first side 214 and the cable shield 120 and/or the second side 216 and the cable shield 120. The first insulator 114 has an outer end 232 opposite the second insulator 116 and the bisector axis 152. The first insulator 114 has a first side 234 (for example, a top side) and a second side 236 (for example, a bottom side) opposite the first side 234. In various embodiments, the first and second sides 234, 236 are equidistant from the outer end 232. The first insulator 114 may be curved between the outer end 232 and the first side 234 and then extend from the first side 234 to the bisector axis 152 along a linear path generally perpendicular to the bisector axis 152. Similarly, the first insulator 114 may be curved between the outer end 232 and the second side 236 and then extend from the second side 236 to the bisector axis 152 along a linear path generally perpendicular to the bisector axis 152. For example, the top and the bottom of the insulator structure 115 may be flat and parallel to each other while the sides of the insulator structure 115 (for example, at the outer end 232) may be curved. In other various embodiments, the top and the bottom of the insulator structure 115 may be curved rather than being flat.

The cable shield 120 engages the first insulator outer surface 222 along a first segment 240. For example, the first segment 240 may extend from the bisector axis 152, along the top to the first side 234, along the outer end 232, along the second side 236 and back along the bottom to the bisector axis 152. The first segment 240 may encompass approximately half of the entire outer surface 150 of the insulator structure 115. The shield distance 228 between the cable shield 120 and the first conductor 110 is defined by the thickness of the first insulator 114 between the inner surface 226 and the outer surface 222. The shield distance 228 affects the electrical characteristics of the signals transmitted by the first conductor 110. For example, the shield distance 228 affects the inductance and the capacitance of the first conductor 110, which affects the delay or skew of the signal, the insertion loss of the signal, the return loss of the signal, and the like. In an exemplary embodiment, the shield distance 228 may be controlled or selected, such as by selecting the position of the first conductor 110 within the first insulator 114. In various embodiments, the first conductor 110 is shifted closer to the cable shield 120 along a transverse axis 154 perpendicular to the bisector axis 152. The transverse axis 154 may be oriented horizontally in various embodiments. The first conductor 110 may be equidistant from the first side 234 and the second side 236. In various embodiments, the shield distance 228 between the outer end 212 and the outer end 232 may be less than the shield distance 228 between the first side 214 and the first side 234 and may be less than the shield distance 228 between the second side 216 and the second side 236.

In the illustrated embodiment, the void 140 is positioned along the first segment 240, such as at a section between the second side 236 and the outer end 232. The elevated segment 142 is thus defined along the first segment 240. The cable shield 120 engages the first insulator outer surface 222 on both sides of the elevated segment 142. The flap 134 wraps around a portion of the first insulator 114, such as from the elevated segment 142 to the outer edge 132. Optionally, the outer edge 132 may be located along the first segment 240, such as approximately aligned with the first side 234.

The void 140 affects the electrical characteristics of the signals transmitted by the first conductor 110. For example, the void 140 decreases capacitance of the first conductor 110 by introducing air in the shield space, which has a lower dielectric constant than the dielectric material of the first insulator 114. The decrease in capacitance reduces the propagation delay, and thus the speed of the signals transmitted by the first conductor 110, which has a skew effect on the signals transmitted by the first conductor 110, relative to the signals transmitted by the second conductor 112. For example, the skew may be affected by having the signals travel faster in the first conductor 110 compared to a hypothetical situation in which no void 140 were present. Thus, the void 140 leads to skew problems in the conductor assembly 102.

The first conductor 110 and/or the first insulator 114 may be modified (for example, compared to the second conductor 112 and/or the second insulator 116) to balance or correct for the skew imbalance, such as to improve the skew imbalance. The first conductor 110 and/or the first insulator 114 may be modified to allow for a zero skew or near-zero skew in the conductor assembly 102. In various embodiments, the positioning of the outer surface 202 relative to the cable shield 120 is different (for example, positioned further apart) than the positioning between the second conductor 112 and the cable shield 120. Shifting the outer end 214 of the first conductor 110 closer to the cable shield 120 changes the shield distance 228 and increases the capacitance between the first conductor 110 and the cable shield 120, which affects the skew and may be used to balance the skew compared to the second conductor 112. Shifting the first conductor 110 closer to the cable shield 120 slows the signal transmission in the first conductor 110 to balance the skew. Shifting the first conductor 110 closer to the cable shield 120 creates an asymmetry in the conductor assembly 102.

In an exemplary embodiment, the first conductor 110 is modified compared to the second conductor 112 to balance or correct for the skew imbalance, such as to improve the skew imbalance. The first conductor 110 is modified to allow for a zero skew or near-zero skew in the conductor assembly 102. In various embodiments, the first conductor 110 is shifted a shift distance 156 closer to the cable shield 120 compared to the position of the second conductor 112. The shift distance 156 creates a decrease in the capacitance proportional to the increase in capacitance due to the void 140 to compensate for the void 140 and keep the delay similar to the second conductor 112 and eliminate skew. The shift distance 156 is selected to balance the delay per unit length compared to the second conductor 112. Even though the first and second sides have different capacitances, due to the void 140 only being present on the first side and absent on the second side, the first side has a complementary increase in capacitance due to the shifting of the first conductor 110 closer to the cable shield 120, leading to a balanced speed of the signals in the first and second conductors 110, 112 to have a zero or near-zero skew imbalance along the length of the electrical cable 100. While the effects are described with reference to a shifting of the first conductor 110, a similar result may be achieved by changing the shape of the first insulator 114, such as at the outer end 232 to change the shield distance 228 between the outer end 212 and the outer end 232.

In an exemplary embodiment, the second conductor 112 has a second conductor outer surface 302 having a circular cross-section having a second diameter 300. The second conductor 112 has an inner end 310 facing the first conductor 110 and an outer end 312 opposite the inner end 310. The second conductor 112 has a first side 314 (for example, a top side) and a second side 316 (for example, a bottom side) opposite the first side 314. The first and second sides 314, 316 are equidistant from the inner and outer ends 310, 312.

In an exemplary embodiment, the second insulator 116 surrounds the second conductor 112 and has a second insulator outer surface 322, defining a portion of the outer surface 150 of the insulator structure 115. A thickness of the second insulator 116 between the second conductor 112 and the second insulator outer surface 322 defines a second shield distance 328 between the second conductor 112 and the cable shield 120. Optionally, the shield distance 328 may be generally uniform between the cable shield 120 and the outer end 312 and the first and second sides 314, 316. The second insulator 116 has an outer end 332 opposite the first insulator 114 and the bisector axis 152. The second insulator 116 has a first side 334 (for example, a top side) and a second side 336 (for example, a bottom side) opposite the first side 334. In various embodiments, the first and second sides 334, 336 are equidistant from the outer end 332. The second insulator 116 may be curved between the outer end 332 and the first side 334 and then extend from the first side 334 to the bisector axis 152 along a linear path generally perpendicular to the bisector axis 152. Similarly, the second insulator 116 may be curved between the outer end 332 and the second side 336 and then extend from the second side 336 to the bisector axis 152 along a linear path generally perpendicular to the bisector axis 152. For example, the top and the bottom of the insulator structure 115 may be flat and parallel to each other while the sides of the insulator structure 115 (for example, at the outer end 332) may be curved. In other various embodiments, the top and the bottom of the insulator structure 115 may be curved rather than being flat.

The cable shield 120 engages the second insulator outer surface 322 along a second segment 340. For example, the second segment 340 may extend from the bisector axis 152, along the top to the first side 334, along the outer end 332, along the second side 336 and back along the bottom to the bisector axis 152. The second segment 340 may encompass approximately half of the entire outer surface 150 of the insulator structure 115. The shield distance 328 between the cable shield 120 and the second conductor 112 is defined by the thickness of the second insulator 116 between the inner surface 326 and the outer surface 322. The shield distance 328 affects the electrical characteristics of the signals transmitted by the second conductor 112. For example, the shield distance 328 affects the inductance and the capacitance of the second conductor 112, which affects the delay or skew of the signal, the insertion loss of the signal, the return loss of the signal, and the like. In an exemplary embodiment, the shield distance 328 may be controlled or selected, such as by selecting the position of the second conductor 112 within the second insulator 116. In various embodiments, the position of the second conductor 112 relative to the cable shield 120 is different than the position of the first conductor 110 relative to the cable shield 120. In various embodiments, the second conductor 112 is symmetrically located within the second insulator 116 relative to the cable shield 120. For example, the second conductor 112 the shield distance 228 at the outer edge 232, the first side 234, and the second side 236 may be equidistant.

In the illustrated embodiment, the second segment 340 does not include any void like the void 140. The second conductor 112 is thus not subjected to the same delay change as the first conductor 110 from the void 140. When comparing the first and second conductors 110, 112, the void 140 creates a skew imbalance between the first and second conductors 110, 112 by decreasing capacitance of the first conductor 110 as compared to the second conductor 112, which affects the velocity or speed of the signal transmission through the first conductor 110 as compared to the second conductor 112. However, the shift of the first conductor 110 compensate for the void 140 and, in the illustrated embodiment, the second conductor 112 does not have any similar shift, but rather is symmetrically positioned in the second insulator 116.

Figure 3:
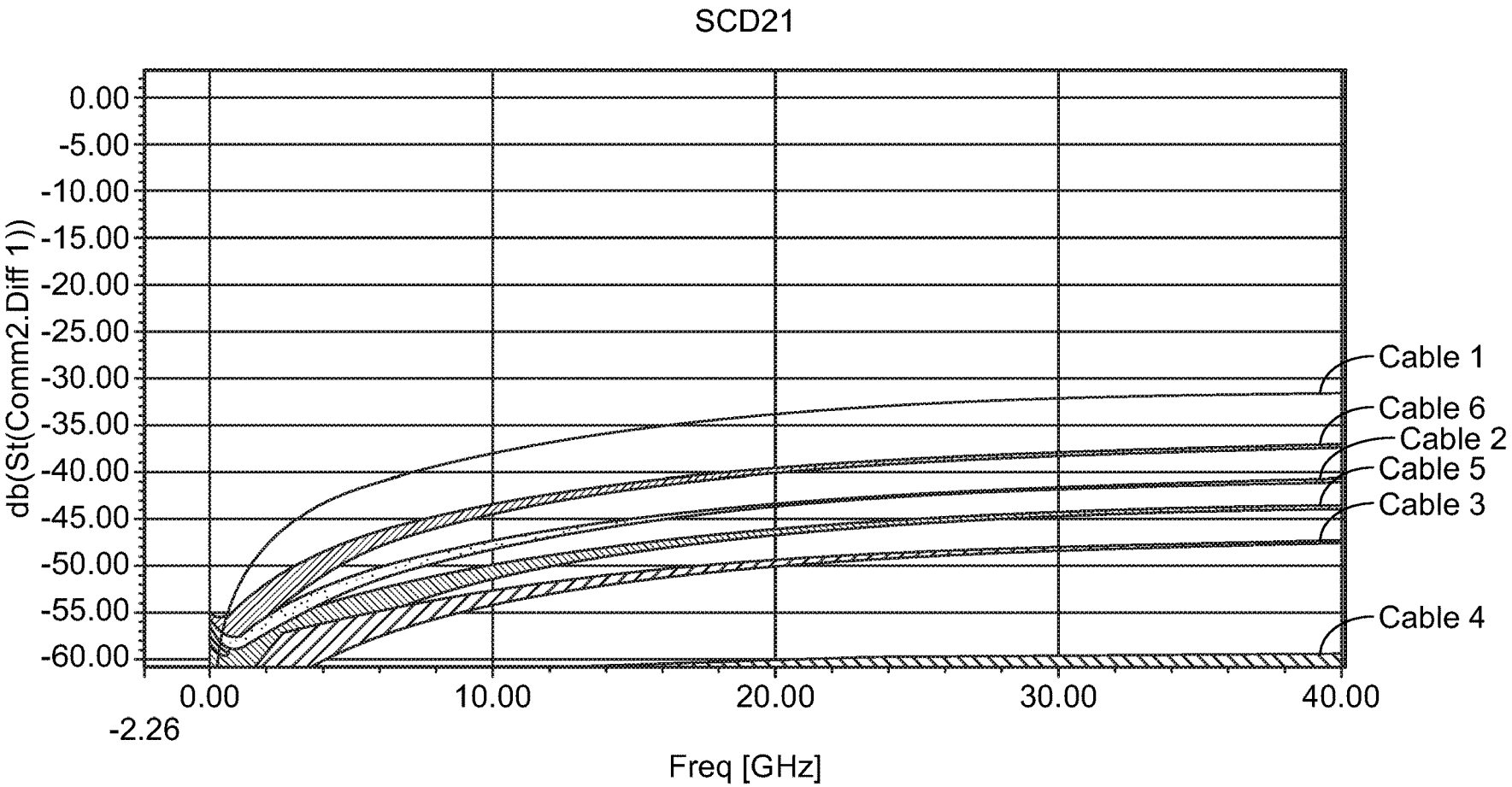
FIG. 3 is a signal integrity chart for exemplary electrical cables in accordance with an exemplary embodiment.

FIG. 3 is a signal integrity chart for exemplary electrical cables in accordance with an exemplary embodiment. FIG. 3 illustrates a differential-common mode conversion chart (SCD21) showing differential-common mode conversion of the exemplary electrical cables. The signal integrity chart illustrates results for different electrical cables, namely cable 1, cable 2, cable 3, cable 4, cable 5 and cable 6. The cables have 0.255 diameter conductors (30 AWG). Cable 1 is a symmetrical electrical cable having the first conductor having a zero shift distance, such as 0.00 mm shift distance. Cable 2 is an exemplary embodiment of the electrical cable 100 having the first conductor having a first shift distance, such as 0.05 mm shift distance. Cable 3 is an exemplary embodiment of the electrical cable 100 having the first conductor having a first shift distance, such as 0.06 mm shift distance. Cable 4 is an exemplary embodiment of the electrical cable 100 having the first conductor having a first shift distance, such as 0.07 mm shift distance. Cable 5 is an exemplary embodiment of the electrical cable 100 having the first conductor having a first shift distance, such as 0.08 mm shift distance. Cable 6 is an exemplary embodiment of the electrical cable 100 having the first conductor having a first shift distance, such as 0.09 mm shift distance.

As shown in FIG. 3, the differential-common mode conversion corresponds to delay skew of the electrical cable. As shown in FIG. 3, cable 4 reaches near-zero skew across most frequencies. Cables 2 and 3 are improvements over cable 1, which has no compensation; however, cable 4 is an improvement over cables 2 and 3. Cables 5 and 6 have worse performance than cable 4. In the illustrated embodiment, selecting a shift distance for the first conductor of approximately 0.07 mm would result in an improved cable having near-zero skew imbalance. While the shift distance is slight compared to the overall diameter of the conductor and size of the electrical cable, the improvement is significant and performance of the electrical cable is enhanced.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical cable comprising:

a conductor assembly having a first conductor, a second conductor, and an insulator structure surrounding the first conductor and the second conductor, the first and second conductors carrying differential signals, the insulator structure having an outer surface; and a cable shield wrapped around the conductor assembly and engaging the outer surface of the insulator structure, the cable shield having an inner edge and a flap covering the inner edge, the cable shield forming a void at the inner edge, the void being located closer to the first conductor than the second conductor, the void compromising the first conductor by reducing an effective dielectric constant surrounding the first conductor;

wherein the first conductor is shifted closer to the cable shield a shift distance compared to the second conductor to increase capacitance of the first conductor compared to the second conductor, the shift distance being selected based on the size of the void and the volume of air introduced in to the void along the first conductor compared to the second conductor along the length of the electrical cable.

2. The electrical cable of claim 1, wherein the shift distance is selected to balance skew effects of the void on the first conductor compared to the second conductor along the length of the electrical cable.

3. The electrical cable of claim 1, wherein the first conductor is located a first shield distance from the cable shield and the second conductor is located a second shield distance from the cable shield, the first shield distance being less than the second shield distance.

4. The electrical cable of claim 3, wherein the first shield distance is selected to balance skew effects of the void on the first conductor compared to the second conductor along the length of the electrical cable.

5. The electrical cable of claim 1, wherein the void has a volume creating a decrease in capacitance of the first conductor compared to the second conductor, the shift distance being selected to create an increase in capacitance in the first conductor compared to the second conductor proportional to the decrease in capacitance due to the void to balance skew effects.

6. The electrical cable of claim 1, wherein the first conductor and the second conductor have equal diameters.

7. The electrical cable of claim 1, wherein the insulator structure is asymmetrical about a bisector axis between the first and second conductors.

8. The electrical cable of claim 1, wherein the second conductor is symmetrically positioned relative to the cable shield and wherein the first conductor is asymmetrically positioned relative to the cable shield.

9. The electrical cable of claim 1, wherein the first conductor includes a first side and a second side opposite the first side and the first conductor includes an inner end and an outer end opposite the inner end, the inner end facing the second conductor, the first and second sides being separated from the cable shield by a first distance, the outer end being separated from the cable shield by a second distance less than the first distance.

10. The electrical cable of claim 9, wherein the second conductor includes a first side and a second side opposite the first side and the second conductor includes an inner end and an outer end opposite the inner end, the inner end facing the inner end of the first conductor, the outer end and the first and second sides being separated from the cable shield by a third distance.

11. The electrical cable of claim 1, wherein the insulator structure includes a bisector axis centered between a first outer end and a second outer end of the outer surface of the insulator structure, the first conductor being a first bisector distance from the bisector axis and the second conductor being a second bisector distance from the bisector axis, the first bisector distance being greater than the second bisector distance.

12. The electrical cable of claim 11, wherein the insulator structure forms a first insulator between the bisector axis and the first outer end and the insulator structure forms a second insulator between the bisector axis and the second outer end, the first and second insulators being mirrored about the bisector axis.

13. The electrical cable of claim 12, wherein the second conductor is centered in the second insulator between the second outer end and the bisector axis, and wherein the first conductor is offset in the second insulator closer to the second outer end than the bisector axis.

14. The electrical cable of claim 1, wherein the first conductor includes a first side and a second side opposite the first side and the first conductor includes an inner end and an outer end opposite the inner end, the inner end facing the second conductor, the insulator structure having a first thickness between the first side and the cable shield, the insulator structure having a second thickness between the second side and the cable shield, the insulator structure having a third thickness between the outer end and the cable shield, the first thickness being equal to the second thickness, the third thickness being less than the first and second thicknesses.

15. An electrical cable comprising:

a conductor assembly having a first conductor, a second conductor, and an insulator structure surrounding the first conductor and the second conductor, the first and second conductors carrying differential signals, the insulator structure having an outer surface including a first outer end and a second outer end opposite the first outer end, the insulator structure having a bisector axis centered between the first outer end and the second outer end, wherein the first conductor is a first bisector distance from the bisector axis and the second conductor is a second bisector distance from the bisector axis, the first bisector distance being greater than the second bisector distance; and a cable shield wrapped around the conductor assembly and engaging the outer surface of the insulator structure, the cable shield having an inner edge and a flap covering the inner edge, the cable shield forming a void at the inner edge, the void being located closer to the first conductor than the second conductor, wherein the void has a volume creating a decrease in capacitance of the first conductor compared to the second conductor, the first bisector distance and the second bisector distance being selected to create an increase in capacitance in the first conductor compared to the second conductor proportional to the decrease in capacitance due to the void to balance skew effects.

16. The electrical cable of claim 15, wherein the first conductor is shifted closer to the cable shield a shift distance compared to the second conductor to increase capacitance of the first conductor compared to the second conductor.

17. The electrical cable of claim 15, wherein the insulator structure forms a first insulator between the bisector axis and the first outer end and the insulator structure forms a second insulator between the bisector axis and the second outer end, the first and second insulators being mirrored about the bisector axis.

18. The electrical cable of claim 17, wherein the second conductor is centered in the second insulator between the second outer end and the bisector axis, and wherein the first conductor is offset in the second insulator closer to the second outer end than the bisector axis.

19. The electrical cable of claim 15, wherein the first conductor is located a first shield distance from the cable shield and the second conductor is located a second shield distance from the cable shield, the first shield distance being less than the second shield distance, the first shield distance being selected to balance skew effects of the void on the first conductor compared to the second conductor along the length of the electrical cable.

20. The electrical cable of claim 15, wherein the first conductor is shifted closer to the cable shield a shift distance compared to the second conductor to define the first bisector distance and increase capacitance of the first conductor compared to the second conductor, the shift distance being selected based on the size of the void and a volume of air introduced along the first conductor compared to the second conductor along the length of the electrical cable.

* * * * *